United States Patent [19]

Clerk

[11] 3,956,972

[45] May 18, 1976

[54] AXIAL PISTON PUMPS OR MOTORS

[76] Inventor: Robert Cecil Clerk, Edison House, Fullerton Road, Glenrothes, Fife, Scotland

[22] Filed: Nov. 13, 1974

[21] Appl. No.: 523,493

Related U.S. Application Data

[63] Continuation of Ser. No. 370,375, June 15, 1973, abandoned.

[52] U.S. Cl. ..... 91/485

[51] Int. Cl.[2] ..... F01B 13/04

[58] Field of Search ..... 91/485, 487

[56] References Cited

UNITED STATES PATENTS

| | | | |
|---|---|---|---|
| 1,362,040 | 12/1920 | Pratt | 91/485 |
| 2,284,169 | 5/1942 | Robinson | 91/485 |
| 3,194,172 | 7/1965 | Schottler | 91/485 |
| 3,253,551 | 5/1966 | Thoma | 91/485 |
| 3,410,220 | 11/1968 | Kratzenberg et al. | 91/485 |
| 3,810,715 | 5/1974 | Week et al. | 91/485 |

FOREIGN PATENTS OR APPLICATIONS

| | | | |
|---|---|---|---|
| 684,551 | 12/1952 | United Kingdom | 91/487 |

*Primary Examiner*—William L. Freeh

*Attorney, Agent, or Firm*—Lerner, David, Littenberg & Samuel

[57] ABSTRACT

The invention provides an axial piston pump/motor in which clearance at the port face between a stationary fluid distribution block and a rotating cylinder barrel is controlled in accordance with impedanced working fluid pressure applied to a hydrostatic bearing.

9 Claims, 2 Drawing Figures

AXIAL PISTON PUMPS OR MOTORS

This is a continuation of application Ser. No. 370,375, filed June 15, 1973 now abandoned.

BACKGROUND OF THE INVENTION

This invention relates to improvements in axial piston pumps or motors and comprises means for controlling the clearance between the port-face and the rotating barrel of such pumps or motors (hereinafter referred to as pumps).

In axial piston hydraulic pumps, where distribution of the working fluid to and from the working cylinders carried by a rotating barrel is effected by co-operating port-faces on the barrel and on the casing, it is usual to employ minimal porting at minimal operating radius to minimize face leakage and, more importantly, port-face fluid-shear drag and heating which can become critical at low through-put and low pressure-leakage. Also, of course, the effective port-face areas have to balance the combined piston areas, as under-balance would allow rubbing contact and wear, whilst over-balance increases leakage and therefore volumetric efficiency loss. Further, there is a substantial imbalance variation as the cylinder ports successively come into and out of communication with the delivery port of the casing port-face.

SUMMARY OF THE INVENTION

The object of the present invention is to provide a method of controlling the port-face running clearance to an optimum value at high pressures and deliveries, despite substantial piston/port-face imbalance, yet to allow increase of clearance at low or zero output pressures so as to reduce considerably idling, or downtime, heating and drag-loss at the port-face.

To this end what we propose is a hydraulic thrust bearing acting between the casing head and directly or indirectly upon the cylinder barrel so as to be in opposition to the port-face thrust. This hydrostatic counterthrust is characterised by the provision of an axially floating thrust-plate having an annular fluid chamber between the floating plate and the casing, the annular area of the said fluid chamber being less than that of inner and outer sealing lands by which it is bounded.

In one preferred construction, a similar, but preferably smaller, hydrostatic thrust unit opposes the counterthrust to control the system stability, but in this case the annular area of the fluid chamber is greater than that of inner and outer lands by which it is bounded.

Whereas the hydrostatic counterthrust is pressured from any of the casing ports via a check-valve controlled gallery and an impedance, the opposing thrust unit is pressured from a constant pressure source via an appropriate impedance.

DETAILED DESCRIPTION OF THE INVENTION

Figure 1:
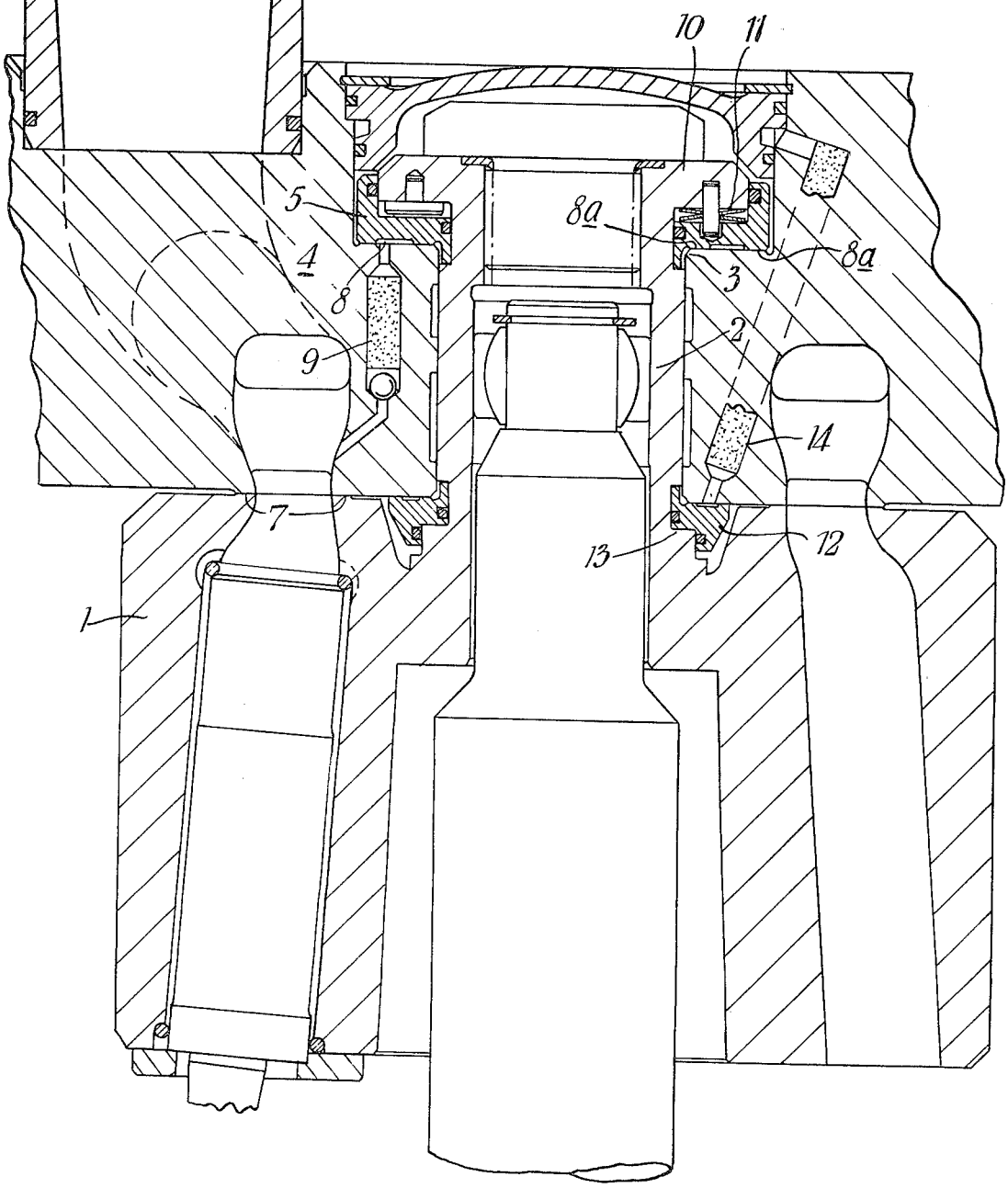
FIG. 1 is a fragmentary, partially diagrammatic, cross-sectional view taken transversely on the vertically disposed axis of pump/motor including a clearance control system in accordance with the invention.

The pump barrel 1 is cast integrally with a sleeve 2 by which it is supported from an internal annular shoulder 3 formed in the casing 4 upon an annular hydrostatic bearing 5.

The pump barrel is rotated in the normal way by its interconnection with a swash plate or carrier therefor by pistons and connecting rods.

The port-face 7 between the barrel 1 and the casing 4 is that which is controlled in accordance with this invention. It is essential that the clearance at this face be minimal when pumped fluid pressures are high, and a good deal greater under idling or low pressure conditions.

To this end the hydrostatic annular bearing pad or plate 5 (of generally Z shaped cross-section) includes a fluid chamber 8 (between lands 8*a*, whose combined annular area is greater than that of the chamber) pressurized by pump outlet pressure through a check valve-controlled impedance 9. This pad 5 applies a lifting force to the upper flange 10 of the sleeve 2 and thus tends to minimise the clearance at the face 7. Springs 11 ensure that such change of port face clearance is progressive.

An auxiliary thrust hydrostatic annular bearing pad 12 abutting an upwardly facing shoulder 13 of the sleeve 2 is pressurised through an impedance 14 from a constant pressure source. This pad, whose fluid chamber area is greater than that of the lands by which it is bounded, controls the stability of the clearance control system.

In operation, with the pump developing a pressure greater than a predetermined fraction of the constant pressure, the counterthrust annulus 5 overpowers the auxiliary thrust annulus 12 plus any differential load at the port-face thus pulling the port-face to the close clearance determined by the limit of the auxiliary annulus collapse; and at any higher pressure the system stability maintains the port-face clearance at, say, seven tenths of a thousandth of an inch and precisely to within a range of approximately one-ten-thousandth of an inch.

When the pump pressure falls below the preset figure, the auxiliary-thrust annulus 12 overpowers the counterthrust annulus 5 to the limit of its collapse, corresponding to the desired open clearance of, say, five to six thousandths of an inch of the port-face for minimum heating and drag.

Figure 2:
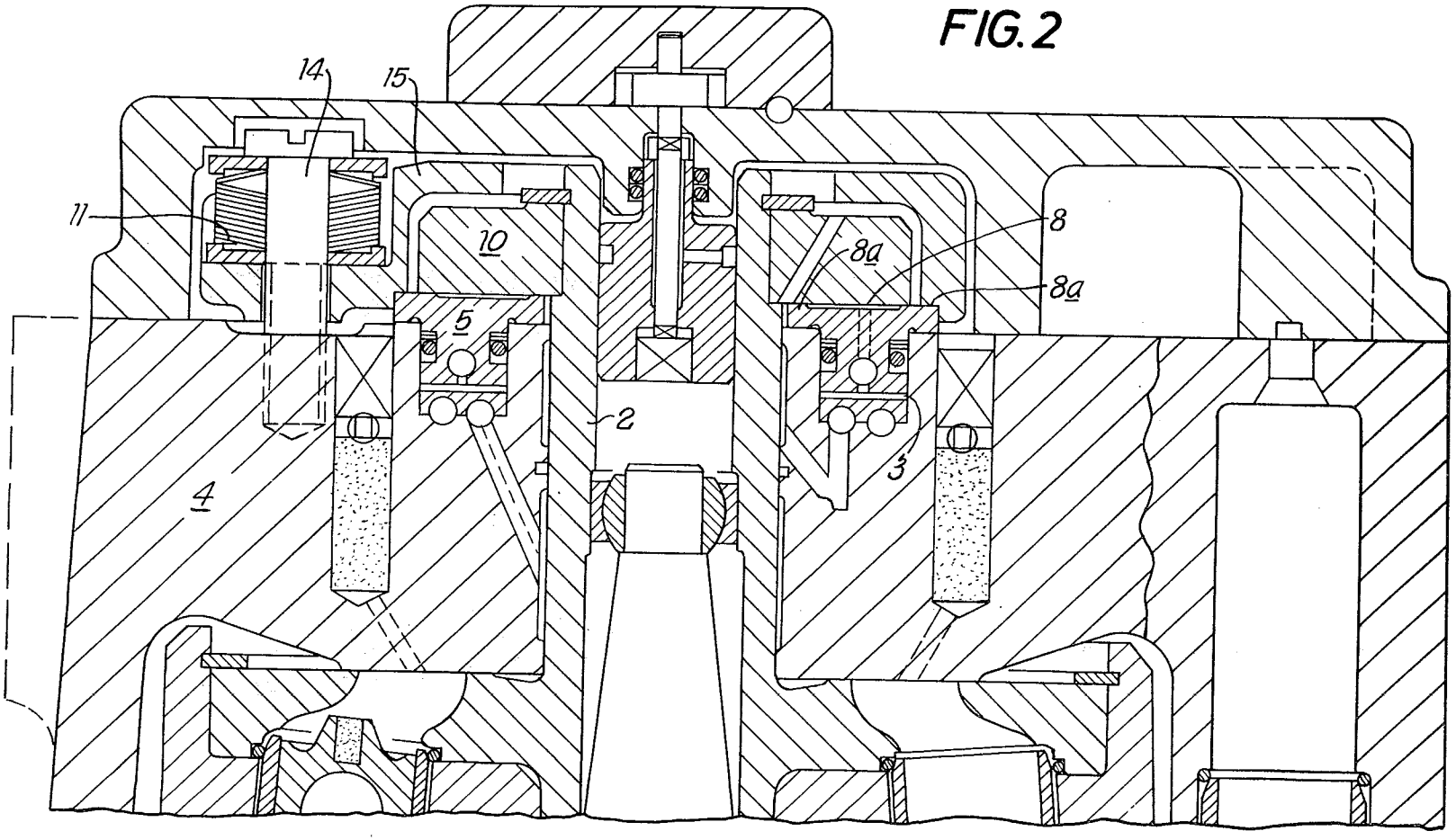
FIG. 2 is a view similar to that of FIG. 1, but showing a modification.

In a modified form of port-face control illustrated in FIG. 2, the bearing pad 12 is omitted and thrust against the upwards force applied to the flange 10 by the bearing pad 5 is supplied by more powerful springs 11 carried on adjustable threaded pins 14 through the intermediary of a crown plate 15.

The combined rate of the springs 11 is such that at zero or very low pumping pressures the port-face clearance is relatively very large, typically 5 times as great as the clearance at highest pressure when the active supporting load in the annular space 3 is balanced by the separating force at the active port-face together with the maximised load of the compressed springs 11.

For certain pump applications it is advantageous for the spring 11 to have variable rate so that the increase of port-face clearance at low pressures is non-linear.

Advantage can be taken by increasing the counterthrust area, to increase the cylinder-port and port-face areas well in excess of piston area balance with a view to increasing throughput without incidence of cavitation in the cylinder ports and cylinders.

I claim:

1. An axial piston pump/motor having a rotating barrel and a port-face and a casing embodying means for varying the clearance between the port-face and the rotating barrel comprising a first axially thrusting annular hydrostatic bearing located between a sleeve integral with said barrel and a first annular piston axially floating in a first annular cylinder in said casing and acting to force said barrel towards said port-face, said first bearing and said first annular cylinder being pressurized through a pressure reducer impedance by pump outlet pressure, and acting in combination with means opposing the thrust of said first floating piston.

2. Axial piston pump/motor according to claim 1, wherein the means opposing the thrust of said first floating piston is a second hydrostatic floating thrust bearing pressurized from a constant pressure source.

3. Axial piston pump/motor according to claim 2, wherein the face of said second hydrostatic thrust bearing includes an annular fluid chamber of annular area greater than that of the inner and outer lands by which it is bounded.

4. An axial piston pump/motor according to claim 1, wherein the face of said first hydrostatic thrust bearing includes an annular fluid chamber of annular area less than that of the inner and outer lands by which it is bounded.

5. An axial piston pump/motor according to claim 4, said first and second annular chambers are supplied with hydraulic fluid by way of impedances.

6. An axial piston pump/motor according to claim 1, wherein the means opposing the thrust of said first bearing is constituted by a plurality of springs acting upon a crown plate.

7. An axial piston pump/motor according to claim 6, wherein said springs have variable rate.

8. An axial piston pump/motor having a rotating barrel and a casing embodying a port-face and means for varying the clearance between the port-face and the rotating barrel comprising an axially floating hydrostatic bearing located between a sleeve integral with the barrel and said casing and acting to force said barrel towards said port-face, said bearing including an annular fluid chamber pressurized through an impedance by pump outlet pressure in combination with a plurality of variable rate spring means acting upon a crown plate and opposing the thrust of said bearing.

9. An axial piston pump/motor according to claim 8, wherein said annular fluid chamber is of an annular area less then that of the inner and outer lands by which it is bounded.

* * * * *